US005368346A

United States Patent [19]

Foster

[11] Patent Number: 5,368,346

[45] Date of Patent: Nov. 29, 1994

[54] SASH LOCK SYSTEM

[76] Inventor: Michael J. Foster, Brigown, St. Philomena's Rd., Crosshaven, Co. Cork, Ireland

[21] Appl. No.: 4,282

[22] Filed: Jan. 14, 1993

[51] Int. Cl.[5] ..... E05C 1/14

[52] U.S. Cl. ..... 292/175; 292/153

[58] Field of Search ..... 292/153, 150, 60, 175, 292/304, 290; 29/437

[56] References Cited

U.S. PATENT DOCUMENTS

| | | | |
|---|---|---|---|
| 8,286 | 8/1851 | Bush . | |
| 47,537 | 5/1865 | Ford . | |
| 184,501 | 11/1876 | Buckley . | |
| 257,722 | 5/1882 | Kempshall | 292/175 |
| 357,116 | 2/1887 | Coultaus et al. . | |
| 532,935 | 1/1895 | Woolery . | |
| 595,290 | 12/1897 | Dowman | 292/150 |
| 672,439 | 4/1901 | Burson | 292/290 |
| 876,429 | 1/1908 | Bleyer | 292/153 |
| 972,769 | 10/1910 | Lark . | |
| 985,652 | 2/1911 | Blinn . | |
| 1,352,624 | 9/1920 | Polcek . | |
| 1,490,221 | 4/1924 | Lynn | 292/153 |
| 1,509,619 | 9/1924 | Talbert . | |
| 1,650,454 | 11/1927 | Langan | 292/304 |
| 1,714,196 | 5/1929 | Vara | 292/60 |
| 1,892,613 | 12/1932 | Edgin | 292/304 |
| 1,992,531 | 2/1935 | Kaufman . | |
| 2,018,346 | 10/1935 | Busby . | |
| 2,076,897 | 4/1937 | Kistner . | |
| 2,098,249 | 11/1937 | Kistner . | |
| 2,357,608 | 9/1944 | Ostrowski . | |
| 2,477,524 | 7/1949 | Oswald et al. . | |
| 2,657,086 | 10/1953 | Sweet | 292/175 |
| 2,845,789 | 8/1958 | Kistner . | |
| 3,082,617 | 3/1963 | Kerman . | |
| 3,233,932 | 2/1966 | Utterback . | |

*Primary Examiner*—Richard E. Moore
*Attorney, Agent, or Firm*—Vidas, Arrett & Steinkraus

[57] ABSTRACT

A locking system for selectively locking two frame members of a window or door to prevent sliding movement of one frame relative to the other. The locking system includes a sleeve and first and second pivotably connected bolt members. A spring urges the bolt members to a position where relative sliding movement between the two frame members is prevented. One of the bolt members can be pivoted and then moved along a line which is perpendicular to the other bolt member in a manner such that the bolt is retained in a retracted position.

6 Claims, 2 Drawing Sheets

SASH LOCK SYSTEM

CROSS REFERENCE TO RELATED APPLICATIONS

Copending application Ser. No. 08/004,317 filed Jan. 14, 1993 and directed to a Method For Locking a Sash.

FIELD OF THE INVENTION

This invention relates to locking or fastening devices and systems for sashes on windows or doors. More particularly, this invention relates to fastening systems for selectively locking sashes on windows or doors.

BACKGROUND OF THE INVENTION

A variety of devices and systems have been used for locking or fastening sashes on windows and doors. See, for example, U.S. Pat. Nos. 47,537; 184,501; 532,935; 1,992,531; 2,018,346; 2,076,897; 2,098,249; 2,357,608; 2,845,789; and 3,082,617. Although some of such fastening systems involve the use of a movable bolt for preventing relative movement of one frame member relative to another frame member, such fastening systems exhibit a number of disadvantages and have not been entirely satisfactory.

Additional fastening systems are described, for example, in U.S. Pat. Nos. 8,286; 357,116; 876,429; 972,769; 985,652; 1,352,624; 1,509,619; 2,657,086; 2,477,524; and 3,233,932. These patents describe fastening systems involving movable bolts, some of which can be locked in a retracted position. However, the fastening systems described therein are cumbersome in use or require specialized hardware.

There has not heretofore been provided a locking system having the advantages and exhibiting the ease of use which are associated with the locking system of this invention.

SUMMARY OF THE PRESENT INVENTION

In accordance with the present invention there is provided an improved locking system for selectively locking first and second frame members of a window or door to prevent sliding movement of one frame member relative to the other. The locking system is very compact and easy to use. It can easily be adapted for use on any conventional sashes.

In a preferred embodiment, the locking system of the invention is for selectively locking first and second frame members of a window or door to prevent sliding movement of one frame member relative to the other, wherein the first frame member includes an aperture or socket therein. The locking system comprises:

(a) a sleeve member carried by the second frame member; wherein the sleeve member is axially aligned with the aperture or socket in the first frame member;

(b) a first bolt member slidably received in the sleeve member and being axially movable between extended and retracted positions; wherein the first bolt member includes first and second end portions; wherein the second end portion extends into the aperture or socket when the first bolt member is in its extended position;

(c) a second bolt member including a connecting end portion and a head portion; wherein the connecting end portion is pivotably connected to the first end portion of the first bolt member; and (d) bias means for biasing the first bolt member to its extended position;

When the second bolt member is urged outwardly from the first frame member the first bolt member is moved axially relative to the sleeve member to its retracted position. When the first bolt member is in its retracted position the second bolt member may be pivoted relative to the first bolt member to a position generally perpendicular to the longitudinal axis of the first bolt member, wherein the first bolt member is retained in its retracted position. The connecting end portion of the second bolt member may include a tapered and reduced diameter end which includes an elongated slot, whereby the second bolt member may be moved along a line generally perpendicular to the longitudinal axis of the first bolt member to further secure the first bolt member in its retracted position. When the first bolt member is in its retracted position, frames 11 and 13 may slide past each other (i.e., they are in unlocked condition).

The locking system of the invention does not require any external hardware to be attached to the frame members. As a result, the locking system can be used in connection with any conventional frames.

Other advantages of the locking system of the invention will be apparent from the following detailed description and the accompanying drawings.

BRIEF DESCRIPTION OF THE DRAWINGS

The invention is described in more detail hereinafter with reference to the accompanying drawings, wherein like reference characters refer to the same parts throughout the several views and in which.

DETAILED DESCRIPTION OF THE INVENTION

Figure 1:
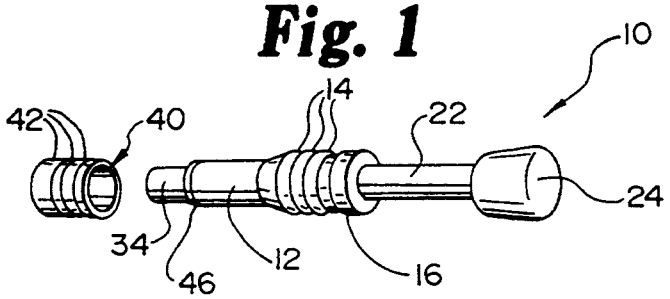
FIG. 1 is a perspective view of a preferred locking system of the invention.
Figure 2:
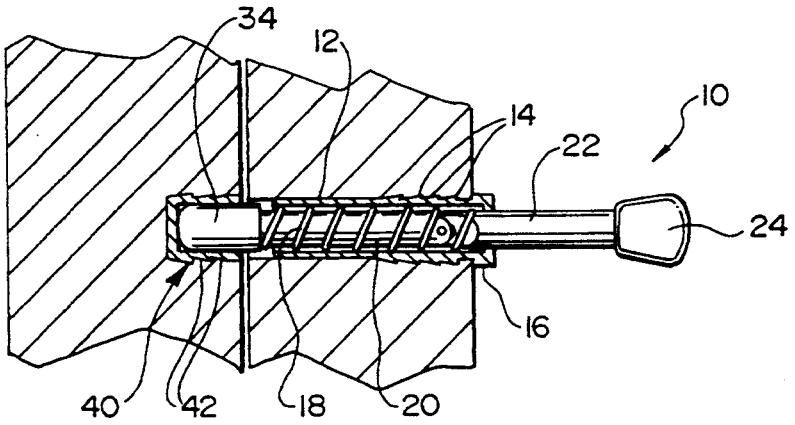
FIG. 2 is a cut-away view illustrating a locking system of the invention.
Figure 3:
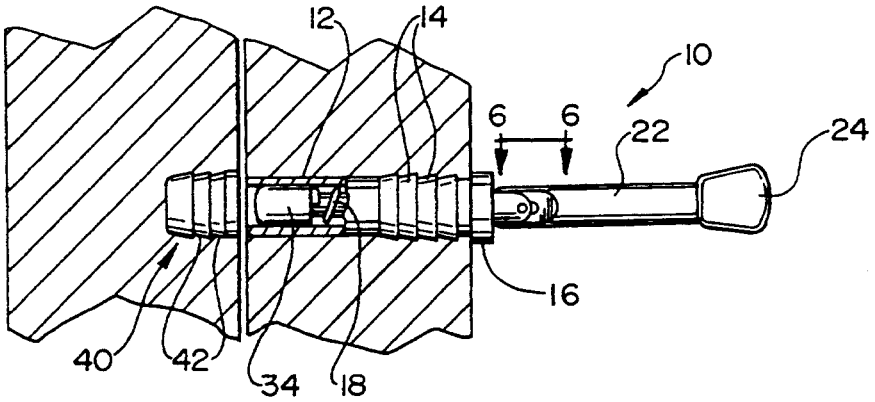
FIG. 3 is a side elevational, partially cut-away, view illustrating the bolt in retracted position.

In the drawings there is shown a preferred locking system 10 of the invention which comprises a first bolt 20 pivotably connected to a second bolt 22 and supported within an elongated sleeve member 12. The sleeve 12 is carried by one of the frame members 13.

A socket or recessed cup 40 is fitted into an aperture in the other frame member 11 in axial alignment with the sleeve in frame member 13, as shown. The exterior surface of the socket 40 preferably includes flutes 42 to facilitate anchoring in the aperture in frame member 11. The exterior surface of the sleeve 12 also preferably include flutes 14 to facilitate anchoring of the sleeve in the frame member 13.

Figure 4:
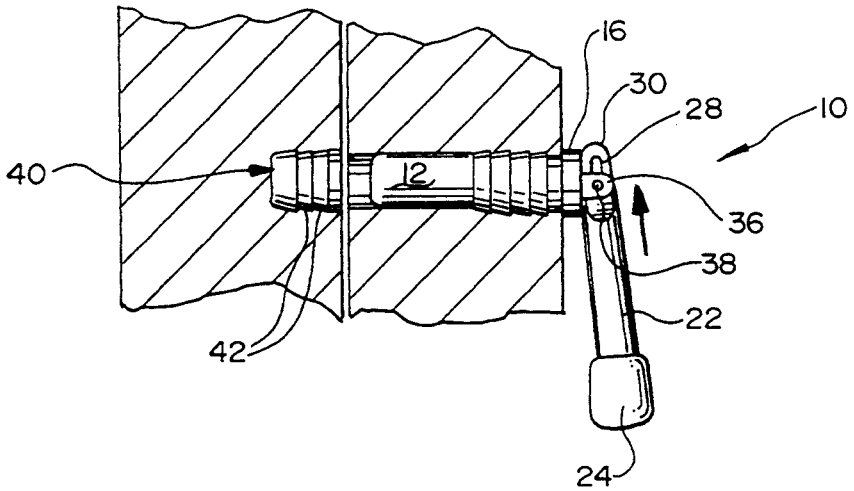
FIG. 4 is a side elevational, partially cut-away, view illustrating the bolt in retracted and locked position.
Figure 5A:
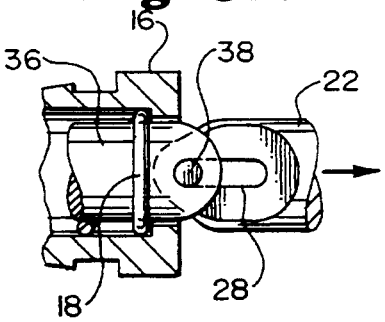
FIGS. 5A–5D are side elevational views showing a preferred manner for connecting the two bolt members used in the locking system of the invention.
Figure 5B:
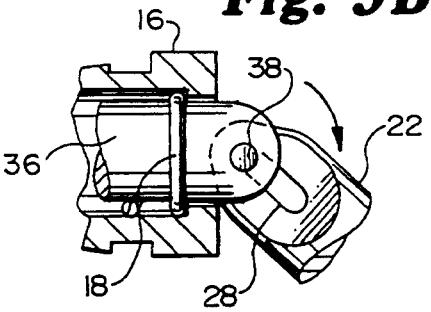
Figure 5C:
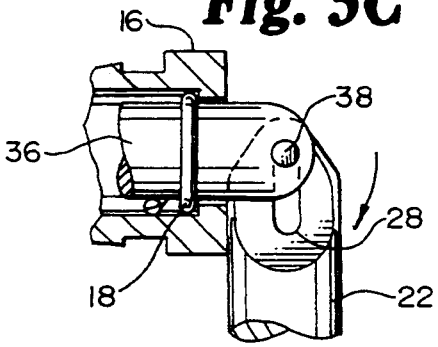
Figure 5D:
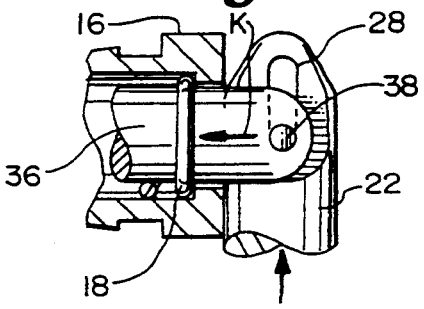
Figure 6:
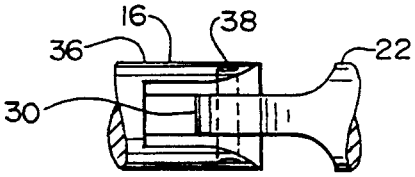
FIG. 6 is a top view showing the connection between the two bolt members.

The bolt members are pivotably connected to each other in end-to-end fashion as shown in FIGS. 5A–5D and FIG. 6. Bolt 22 includes a tapered and reduced diameter end 30 having an elongated slot 28 extending therethrough. The connecting end 36 of bolt member 20 includes a yoke or U-shaped portion which is pivotably connected to the tapered end 30 of bolt 22 by means of pin 38. This arrangement enables bolt 22 to be pivoted with respect to bolt 20 (when bolt 20 is in its retracted position), and it also enables bolt 22 to be moved in a direction generally perpendicular to the longitudinal axis of bolt 20 to thereby lock the bolt 20 in its retracted position. The direction of movement is shown by the arrow. End 30 of bolt 22 is preferably rounded, as shown to facilitate pivotal movement of bolt 22 withouth interference with end 16 of sleeve 12. This is illustrated in FIG. 4.

When bolt 22 is in axial alignment with bolt 20, both bolt members are urged in the direction of frame member 11 by means of spring means 18. Preferably the outer end of bolt 20 includes an enlarged end 34 which is sized to be slidably received in the socket or recess 40 when the two frame members are in proper alignment. One end of spring 18 bears against the enlarged head 34, and the other end of the spring bears against the end 16 of the sleeve 12, as shown. Thus, the spring urges bolt 20 to a normally-extended position where it is slidably received in socket or recess 40 in frame 11, unless bolt 20 has been locked in its retracted position as shown in FIG. 4. Enlarged end 24 on the outer end of bolt 22 facilitates gripping of the bolt 24 for movement thereof.

The sleeve 12 may be inserted into an appropriate aperture or opening provided in frame 13. One end 46 of sleeve 12 is preferably bevelled to facilitate insertion into an opening through frame 13.

The slot 28 in bolt 22 may be of any size so long as (a) bolt 22 may be pivoted to a position generally perpendicular to bolt 20, and (b) bolt 22 may be moved along a line generally perpendicular to the longitudinal axis of bolt 20 in a manner such that bolt 22 locks bolt 20 in its retracted position. The arrangement shown in FIG. 4 is preferred, i.e., bolt 22 bears against the outer end 16 of sleeve 12 to retain bolt 20 in its retracted position.

Other variants are possible without departing from the scope of this invention. For example, there may be a plurality of spaced sockets or recessed areas 40 in frame 11 so that frame 11 may be locked in any of a plurality of different positions relative to frame 13.

What is claimed is:

1. A locking system for selectively locking first and second frame members of a window or door to prevent sliding movement of one said frame member relative to the other; wherein said first frame member includes an aperture therein; said locking system comprising:

(a) a sleeve member carried by said second frame member; wherein said sleeve member is axially aligned with said aperture in said first frame member;

(b) a first bolt member slidably received in said sleeve member and being axially movable between extended and retracted positions; wherein said first bolt member includes first and second end portions; wherein said second end portion extends into said aperture when said first bolt member is in said extended position;

(c) a second bolt member including a connecting end portion and a head portion; wherein said connecting end portion is pivotably connected to said first end portion of said first bolt member, and said connecting end portion of said second bolt member is received within said sleeve member when said first bolt member is in its extended position;

(d) bias means for biasing said first bolt member to its said extended portion; wherein when said second bolt member is urged outwardly from said first frame member said first bolt member is moved axially relative to said sleeve member to said retracted position; wherein when said first bolt member is in said retracted position said second bolt member may be pivoted relative to said first bolt member to a position generally perpendicular to the longitudinal axis of said first bolt member, whereby said first bolt member is retained in said retracted position.

2. A locking system in accordance with claim 1, wherein said connecting end portion of said second bolt member includes an elongated slot, whereby after said second bolt member is pivoted relative to said first bolt member, said second bolt member may be moved along a line to a position generally perpendicular to the longitudinal axis of said first bolt member and secured in said retracted position.

3. A locking system in accordance with claim 2, wherein said first end portion of said first bolt member further comprises pin means extending through said elongated slot for pivotably connecting said first and second bolt members together.

4. A locking system for selectively locking first and second frame members of a window or door to prevent sliding movement of one said frame member relative to the other; wherein said first frame member includes an aperture therein; said locking system comprising:

(a) a sleeve member for attachment to one of said frame members;

(b) a first bolt member slidably received in said sleeve member and being axially movable between extended and retracted positions;

(c) a second bolt member including a connecting end portion and a head portion; wherein said connecting end portion is pivotably connected to said first end portion of said bolt member and said connecting end portion of said second bolt member is received within said sleeve member when said first bolt member is in its extended position;

(d) bias means for biasing said first bolt member toward its said extended position;

wherein when said second bolt member is urged outwardly from said first frame member said first bolt member is moved axially relative to said sleeve member to said retracted position; wherein when said first bolt member is in said retracted position said second bolt member may be pivoted relative to said first bolt member to a position generally perpendicular to the longitudinal axis of said first bolt member, whereby said first bolt member is retained in said retracted position.

5. A locking system in accordance with claim 4, wherein said connecting end portion of said second bolt member includes an elongated slot, whereby after said second bolt member is pivoted relative to said first bolt member, said second bolt member may be moved along a line to a position generally perpendicular to the longitudinal axis of said first bolt member and secured in said retracted position.

6. A locking system in accordance with claim 5, wherein said first end portion of said first bolt member further comprises pin means extending through said elongated slot for pivotably connecting said first and second bolt members together.

* * * * *